US005279387A

United States Patent [19]

Swiderski et al.

[11] Patent Number: 5,279,387

[45] Date of Patent: Jan. 18, 1994

[54] ARTICULATED LADDER ASSEMBLY

[75] Inventors: Paul R. Swiderski, Georgetown; Paul J. Seadler, Jefferson, both of Ky.

[73] Assignee: Emerson Electric Co., St. Louis, Mo.

[21] Appl. No.: 765,369

[22] Filed: Sep. 25, 1991

[51] Int. Cl.[5] ..... E06C 1/00; E06C 7/00

[52] U.S. Cl. ..... 182/27; 182/108; 182/163; 403/97

[58] Field of Search ..... 182/27, 104, 163-164, 108, 214; 403/103, 107, 374, 350, 97, 111; 248/188.9

[56] References Cited

U.S. PATENT DOCUMENTS

| | | | |
|---|---|---|---|
| 1,973,226 | 9/1934 | Rose et al. | 248/188.9 X |
| 2,003,844 | 6/1935 | Tintner | 403/97 |
| 2,273,124 | 2/1942 | McDaniels | 182/108 X |
| 4,474,264 | 10/1984 | Krause . | |
| 4,474,387 | 10/1984 | Maranell et al. | 248/188.9 X |
| 4,543,006 | 9/1985 | Wang . | |
| 4,648,481 | 3/1987 | Lee . | |
| 4,666,327 | 5/1987 | Su . | |
| 4,773,503 | 9/1988 | Purkapile | 403/97 X |
| 4,842,098 | 6/1989 | Yuen | 182/27 X |
| 4,947,959 | 8/1990 | Yuen | 182/163 X |
| 5,026,198 | 6/1991 | Lin | 182/163 X |
| 5,141,076 | 8/1992 | Joyce et al. | 248/188.9 X |

FOREIGN PATENT DOCUMENTS

| | | | |
|---|---|---|---|
| 848 | 2/1979 | European Pat. Off. | 182/27 |
| 2634752 | 2/1978 | Fed. Rep. of Germany | 182/27 |
| 2931745 | 2/1981 | Fed. Rep. of Germany | 182/27 |
| 3505914 | 8/1986 | Fed. Rep. of Germany | 182/108 |
| 2216168 | 10/1989 | Fed. Rep. of Germany | 182/108 |
| 334409 | 9/1904 | France | 182/108 |
| 2534307 | 4/1984 | France | 182/163 |

OTHER PUBLICATIONS

Multi-Master Articulated Aluminum Ladders.
MultiMatic Aluminum Ladder.
Jaws Ladder.

*Primary Examiner*—Karen J. Chotkowski
*Attorney, Agent, or Firm*—Polster, Lieder, Woodruff & Lucchesi

[57] ABSTRACT

An assembly including several ladder sections positionable in several different ladder use positions, wherein intermeshable teeth elements can be cam locked selectively into such positions, and further including stabilizer bars at the ladder section ends for stable engagement with a supporting surface.

20 Claims, 8 Drawing Sheets

ARTICULATED LADDER ASSEMBLY

BACKGROUND OF THE INVENTION

The present invention relates to an articulated ladder assembly and more particularly to an adjustable position ladder assembly which includes a novel hinge and lock joint assembly for connecting pairs of adjacent ladder rails, a novel reinforced structure for assembling pairs of ladder rails with the hinge assembly and a novel stabilizer bar readily adaptable to various angular positions of the ladder assembly.

Articulated ladder assemblies are generally well known in the art including those having adjustable coupling hinges on pairs of adjacent rails which include rotatable facing disks which can be held in locked relation of more than one preselected angular position. In this regard, attention is directed to U.S. Pat. No. 4,474,264, issued to G. Krause on Oct. 2, 1984, to No. 4,543,006, issued to Chien-Yuan Wang on Sep. 24, 1985, and to No. 4,648,481, issued to Dickey Lee on Mar. 10, 1987, each of which patents teaches such a facing relatively rotatable disk assembly, each assembly having spaced peripheral disk notches engageable by a spring loaded releasable pawl. Attention further is directed to U.S. Pat. No. 4,666,327, issued to George Su on May 19, 1987, which teaches a spaced, bifurcated disk member, relatively moveable to a sandwiched disk inserted therebetween, the disks having alignable apertures adapted to receive a depending pin to lock the disks at various preselected annular positions. Attention also is directed to the Multi-Master and MultiMatic bulletins of R. D. Werner Co., Inc. and Krause Company, respectively, which teach adjustable position peripheral lock hinges and cured surface stabilizing bars for end ladder rail sections. Finally, attention is directed to the Jaws Ladder Mfg., Inc. of Weston, Ontario, Canada bulletin, which teaches an intermeshing teeth, hingelock system with the intermeshed teeth being locked into position through a centrally disposed hinge screwlock handle.

In accordance with the present invention, an improved ladder assembly is provided which is straightforward, efficient and economical in manufacture, assembly and operation, requiring a minimum of parts and providing a stable support in positively locked alternative ladder positions. Further, the present invention provides a unique multi-teeth intermeshing arrangement which optimizes shear strength and which allows for ready adjustment to preselected angular positions, to be releasably held in such preselected positions by a comparatively straightforward and easy to operate snap-lock arrangement. In addition, the present invention provides a unique readily assembled, strength reinforced hinge and rail structure and a unique stabilizing structure for a ladder which provides maximum ground contact and ladder stability at more than one preselected angular position of the ladder.

Various other features of the present invention will become obvious to one skilled in the art upon reading the disclosure set forth herein. In this regard, it is to be understood that several of the disclosed features of the present invention are not to be considered as limited to the particular articulated ladder assembly described herein but that such unique features as the intermeshing teeth, hinge locking assembly, the wrap around structural reinforcing arrangement and the multi-faced stabilizing bar can be utilized in other types of ladder assemblies.

BRIEF SUMMARY OF THE INVENTION

More particularly the present invention provides an adjustable position ladder joint assembly for connecting and selectively positioning adjacent ends of at least one pair of adjacent ladder rails linearly positionable in more than one relative fixed angular position comprising: first and second oppositively facing hinge elements connected to adjacent ends of each of the adjacent ladder rails, the oppositely facing hinge elements being mounted on a joint axle to be rotatably and longitudinally moveable with respect to each other on the joint axle with opposed faces of the hinge elements having sets of offset intermeshable teeth extending between the rims and joint axle to allow the opposed teeth on the opposed hinge elements to be intermeshably engaged and locked at preselected angular positions with respect to each other; means to urge the facing hinge elements apart on the axle for positional rotation on the axle; and, lever locking means pivotally cooperable with the joint axle to longitudinally urge and lock the hinge elements together with their respective teeth intermeshing, locking the opposed elements at a preselected angular position. In addition, the present invention provides a unique cam locking arrangement which includes a flat, "oil-canning" disk spring to facilitate cam action and act as a wear surface, a unique wraparound structure to reinforce the hinge element and ladder rail in firmly joined position and a unique extended, multi-surface stabilizing bar.

It is to be understood that various changes can be made by one skilled in the art in one or more of the several parts of the apparatus disclosed herein without departing from the scope or spirit of the present invention.

BRIEF DESCRIPTION OF THE DRAWINGS

Referring to the drawings which disclose one advantageous embodiment of the present invention.

DETAILED DESCRIPTION OF THE DRAWINGS

Figure 1:
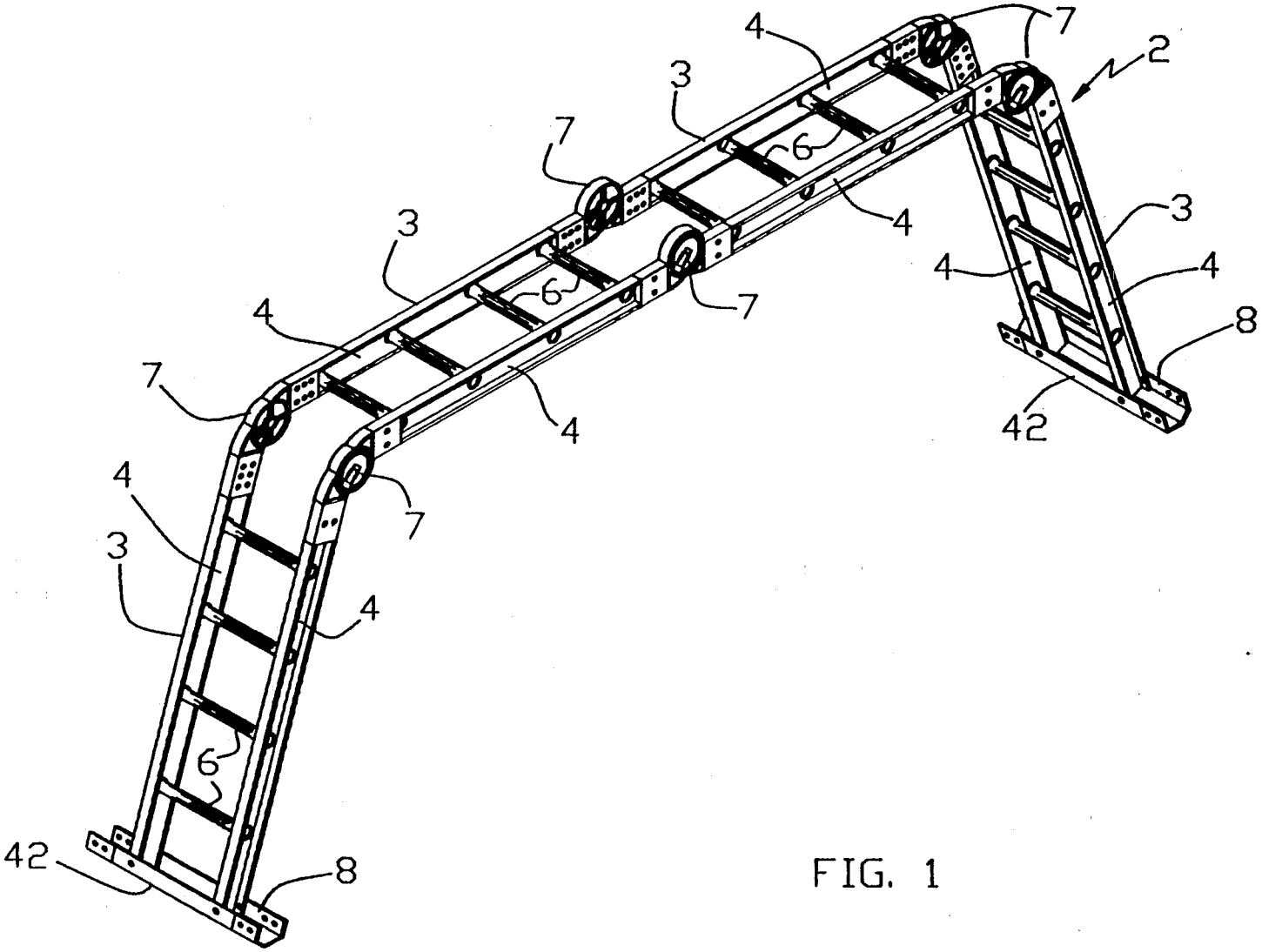
FIG. 1 is a perspective view of a four ladder section articulated ladder assembly incorporating the novel features of the present invention, the articulated ladder being in platform supporting or scaffold position.
Figure 2:
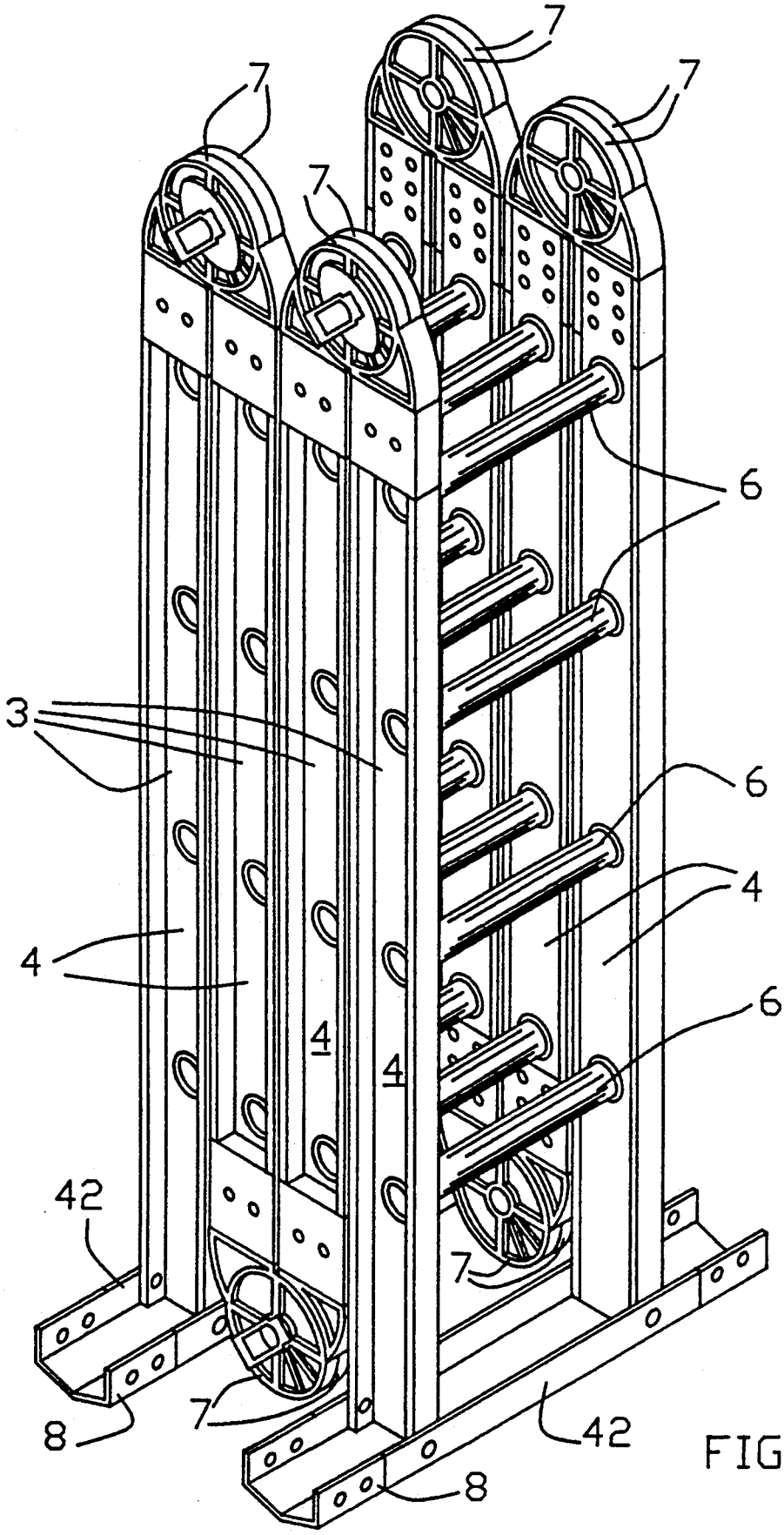
FIG. 2 is a perspective view of the articulated ladder assembly of FIGS. 1, the articulated ladder being in collapsed position.
Figure 3:
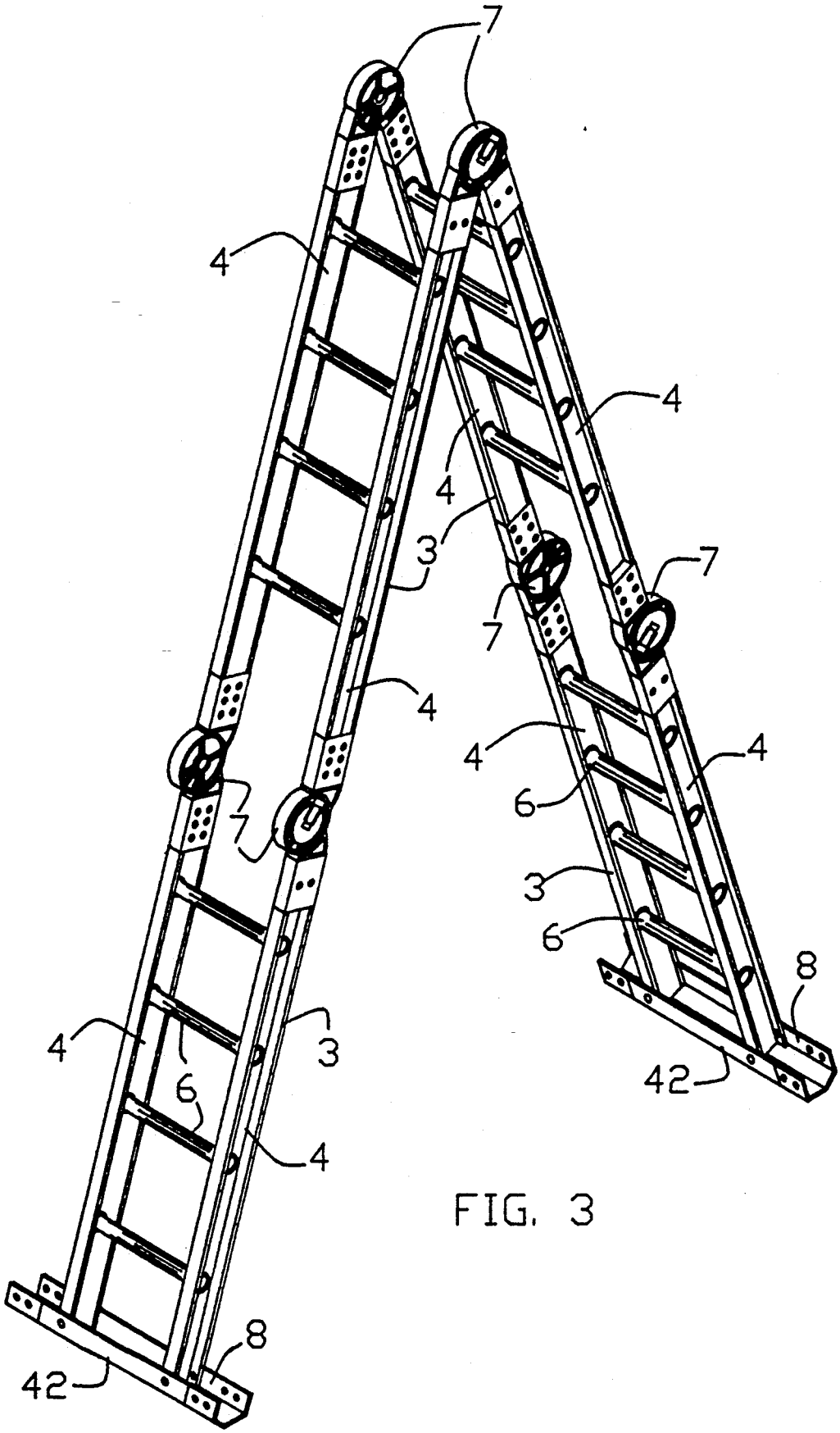
FIG. 3 is a perspective view of the articulated ladder assembly of FIG. 1, the articulated ladder being in step-ladder position.

Referring to FIGS. 1–3, three of the numerous positions in which the inventive adjustable position ladder assembly 2 can be angularly adjusted are disclosed including the platform position of approximately one hundred and eight degrees (108°) of FIG. 1, the collapsed or storage position of approximately zero degrees (0°) of FIG. 2 and the step ladder position of approximately thirty six degrees (36°) of FIG. 3. It is to be understood that the ladder assembly of the present invention is not to be considered as limited to these three shown positions but that the ladder sections 3 can be angularly adjusted to numerous other positions including positions of a shorter double step ladder, a fully extended straight ladder position of approximately one hundred and eighty degrees (180°), a three-quarter length straight ladder, a supported span scaffold, a short span scaffold, a stairwell scaffold, a worktable or multi-shelf and a stand off ladder folded in accordance with the working surfaces involved and the hinge assembly limitations.

As shown in FIGS. 1–3 of the drawings, the adjustable position ladder assembly includes at least four ladder rail sections hingedly connected together and broadly referred to by the reference numeral 3. As shown, the assembly 2 includes two hingedly joined intermediate ladder rail sections which in turn are hingedly joined at opposite extremities by two spaced end ladder sections. Each of the four ladder rail sections 3 is comprised of a pair of spaced substantially parallel, longitudinally extending ladder rails 4 of channel shape cross-section and having spaced rungs 6 extending normal to the opposed bases thereof and fastened thereto in anyone of several ways known in the ladder art such as by suitable crimpling of the rung ends against opposite faces of the base section of the channel shaped rail. It is to be understood that the ladder rails and rungs can be formed from any one of a number of suitably strong materials such as aluminum, wood, plastic or fiberglass. It is to be noted that each of the intermediate ladder rail section 3 are provided with hinge elements or plates 7 at opposite extremities of each of the rail pairs 4 forming a ladder section 3. These hinge elements 7 at the ladder section extremities are selectively of mating oppositely facing male and female contour to allow joint assembly hinge connection in a manner described more fully hereinafter. In this regard, the hinge elements 7 at opposite rail ends of one intermediate ladder rail section 3 are male. The hinge elements 7 at opposite rail ends of the other intermediate ladder rail section 3 are female. Thus, the intermediate rail sections 3 can be hingedly joined together through mated male and female joint assemblies with their opposite extremities presenting male and female hinge elements or plates 7 at opposite extremities of the hinged intermediate sections 3. To this effect, the hinge elements 7 at the upper rail portions of each end rail section 3 are accordingly female and male to provide appropriate mated joint hinge assemblies to the hingedly joined intermediate rail sections. It is to be noted that each of the end ladder rail sections 3 are provided with hinge element pairs 7 at only one end thereof. The opposite rail extremities of each end ladder rail section 3 serve to receive a unique stabilizing bar 8 extending thereacross, also described more fully hereinafter.

The novel joint hinge assembly for joining oppositely facing male and female hinge elements or plates 7 described above are disclosed in more detail in FIGS. 4–8 and 10–14.

Figure 12:
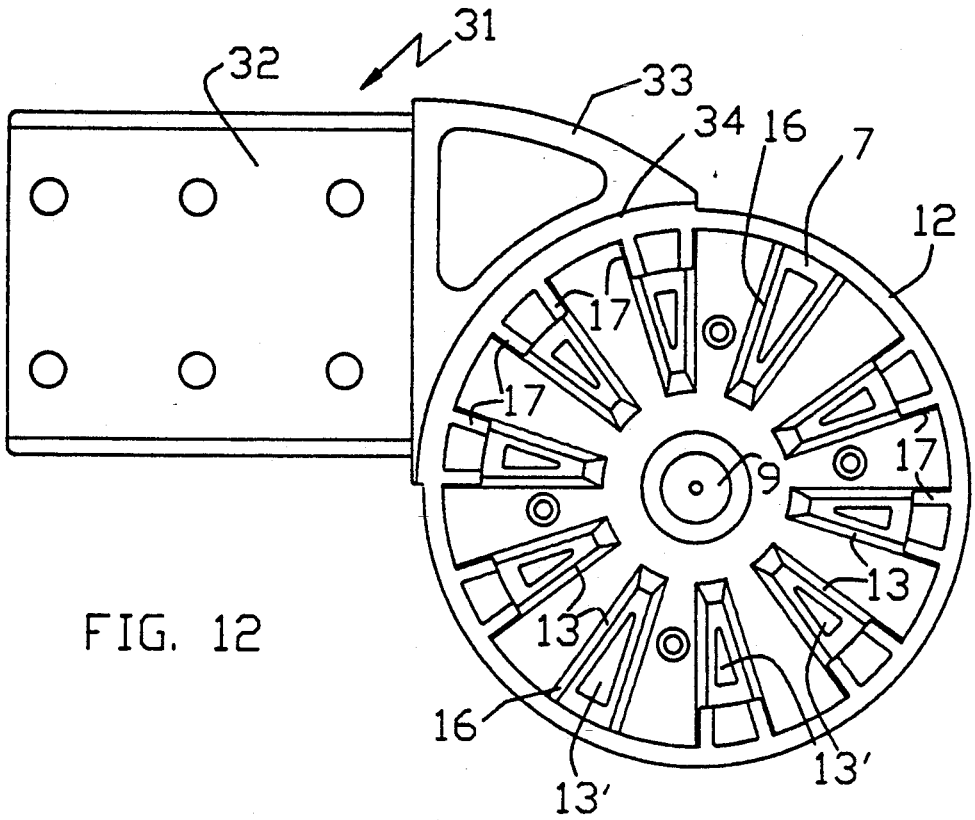
FIG. 12 is an enlarged plan view, disclosing the teeth side of a male hinge element such as disclosed in FIGS. 4–6.
Figure 13:
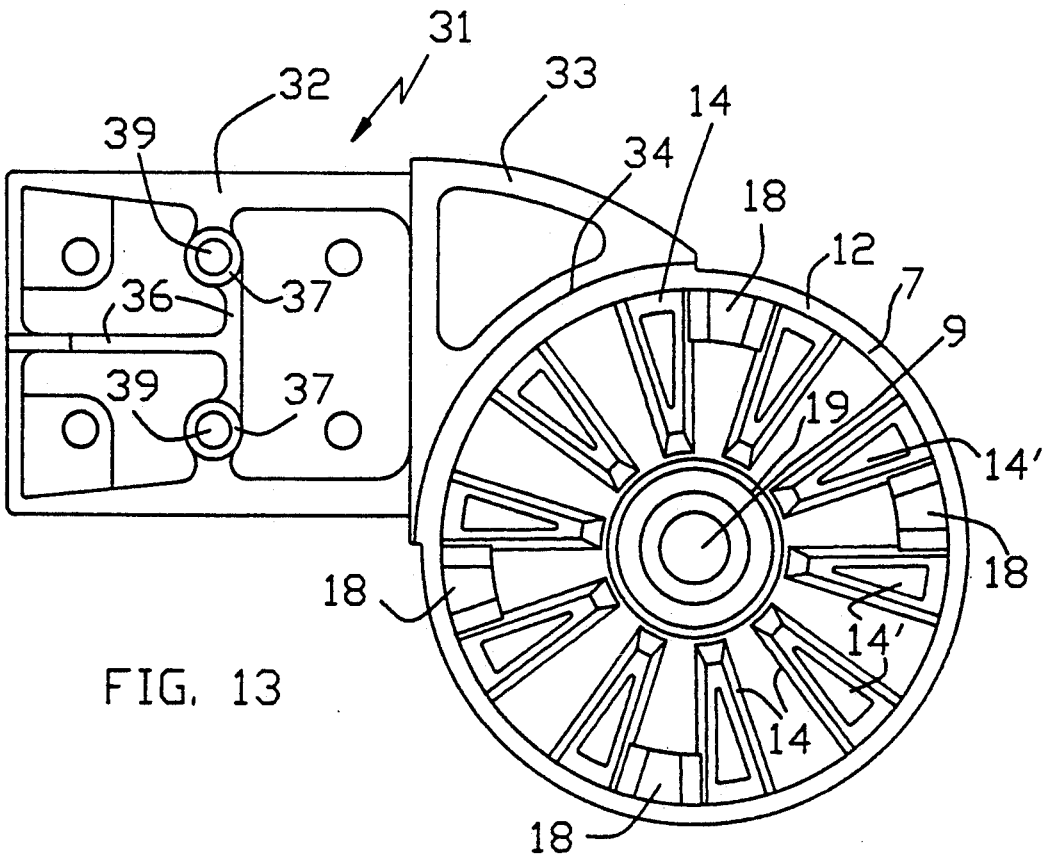
FIG. 13 is an enlarged plan view, disclosing the teeth side of a female hinge element such as disclosed in FIGS. 10 and 11.
Figure 14:
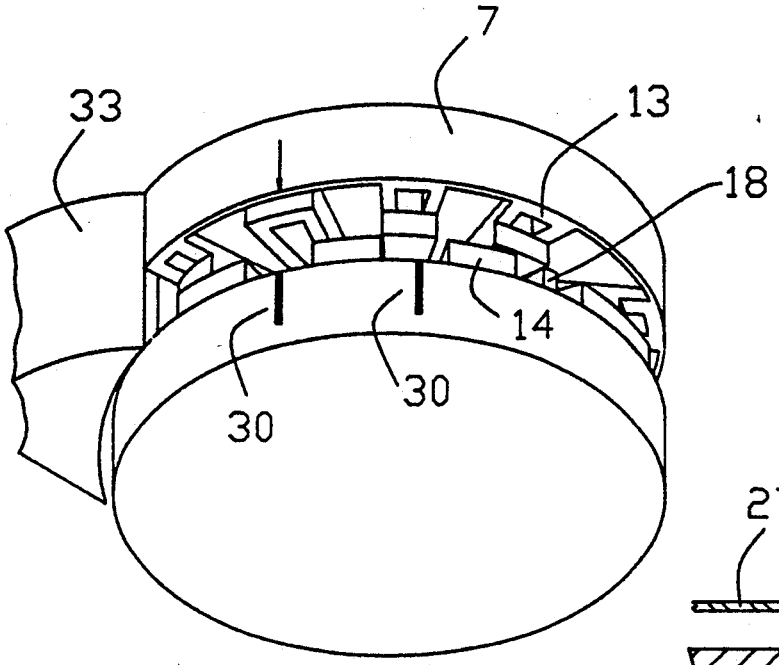
FIG. 14 is an enlarged perspective side view of a portion of the coupled male and female hinge elements in related alignment for engagement in a selected position, such as in FIG. 2.

Referring particularly to FIGS. 12, 13 and 14 of the drawings, there is disclose enlarged views of a matable male (FIG. 12) and female (FIG. 13) hinge plate assembly which can be connected to adjacent ends of a pair of linear aligned ladder rails 4 of linear aligned ladder rail sections 3 to be aligned for teeth meshing engagement. Each hinge element or plate 7 is provided with a centrally disposed aperture 9 to be mounted on a joint axle 11 (FIG. 11) which is arranged to extend through the apertures 9 of facing male and female hinge elements or plates 7. Although not shown in detail, joint axle 11 can be in the form of a pin having a multi-sided head adapted to engage with a multi-sided recess on the outer face of a hinge element 7, restraining pin 11 from axial rotation. The other end of each pin 11 is flattened to receive a bifurcated handle as described hereinafter, and includes aperture 10 for a suitable cotter key (not shown). Facing male and female hinge elements or plates 7 are mounted in pivotable pairs on joint axles 11, to be rotatably and longitudinally moveable with respect to each other on joint axles 11. Each hinge element 7—male and female—is of corresponding and conforming circular shape and each includes a longitudinally and inwardly extending peripheral rim 12. Rims 12 surround sets of male and female offset intermeshable spaced teeth 13 (FIG. 12) and 14 (FIG. 13), respectively, with the peripheral rims 12 of each hinge adjacently facing each other when spaced teeth sets 13 and 14 are intermeshed (FIG. 14). Each set of offset intermeshable spaced teeth 13 and offset spaced teeth 14 includes a plurality of triangularly shaped, spaced teeth with each tooth of the sets of teeth defining a triangularly shaped aperture 13' and 14' therein, respectively. The triangular shaped spaced teeth of offset teeth sets 13 and 14 extend radially inwardly from their respective peripheral rims 12 with the apices of the triangles in each set 13 and 14 being preselectively positioned proximate the central apertures 9 which accommodate joint axle 11. The extended length and triangular shape of the spaced teeth sets serves to optimize the shear resistance strength of the teeth when in held lock intermeshed rotationally arrest position. It is to be noted that the male set of teeth 1 (FIG. 12) includes a pair of prime triangular teeth 16 which extend fully above the inner face of rim 12 and radially toward each other from peripheral rim 12 at positions 180 apart. The remaining teeth of male set 13 have their base portions stepped down to provide truncated portions 17 which in height are substantially even with the inner face of rim 12. The other female set of spaced teeth 14 (FIG. 13) which can be offset to mesh with spaced teeth 13 are selectively provided between certain of the spaced teeth 14 with prime tooth blocks 18. In FIG. 13, four such prime tooth blocks 18 are disclosed. The center lines of these blocks 18 between female teeth 14 are circumferentially spaced apart in clockwise order from the top block 18 in FIG. 13 successively 72°, 180° and 252° within peripheral rim 12 and include raised truncated triangles sized, positionable and of a height adjacent peripheral rim 12 to engage and interlock the truncated apertures of truncated triangular portions 17. It is to be noted that prime teeth blocks 18 are positioned between preselected spaced female teeth 14 (FIG. 13) so as to allow the aforediscussed prime teeth 16 of male set 13 to intermeshingly engage only with the female set of spaced teeth 14 at preselected angular positions with the raised triangular portions of truncated prime tooth blocks 18 on the female set of spaced teeth 14 intermeshing with the base truncated apertures formed by truncated portions 17 of spaced male teeth set 13 to thus increase intermeshing shear strength. It further is to be note that the male and female teeth sets 13 and 14 abovedescribed along with the aforementioned prime teeth 16 and raised prime teeth blocks 18 allow teeth set intermeshing only at 0° , 36°, 108° and 180° to permit the collapsed, step ladder, platform and straight ladder positions above discussed. In this regard, attention is directed to the indexing marks 30 of FIG. 14 on the outer faces of the circular peripheries of mating hinge element pairs 7.

Referring to FIG. 13, the top of a coil spring 19 is disclosed positioned between the apices of the female set 14 of triangular shaped teeth and the center aperture 9. Coil spring 19 (only the top portion of which is disclosed) surrounds joint axle 11 when is passed through central apertures 9 and is interposed between the facing pair of hinge elements or plates, serving to urge the intermeshable teeth sets 13 and 14 of facing male and female circular hinge elements or plates 7 apart or away from each other on joint axle 9 to allow for angular positional rotation of the hinge plates into teeth meshable alignment.

Figure 17:
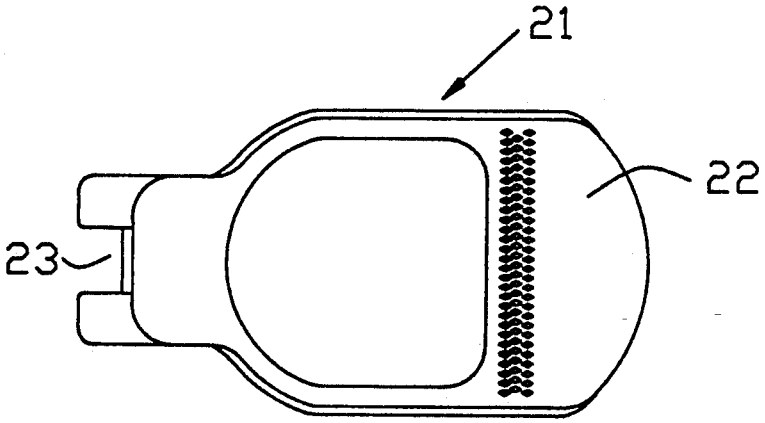
FIG. 17 is an enlarged plan view of the unique cam-lock handle associated with a hinge element joint axle of the present invention; and, FIG. 18 is an enlarged side view of the cam-lock handle of FIG. 17.
Figure 18:
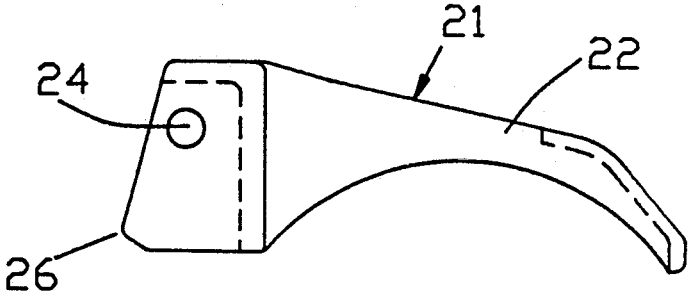
Figure 16:
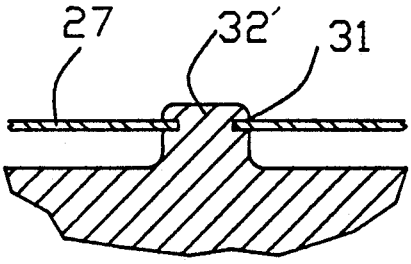
FIG. 16 is a further enlarged cross-sectional portion view taken in a plane through line 16—16 of FIG. 15, disclosing one manner of fastening a wear spring to the outer side of a hinge element.
Figure 15:
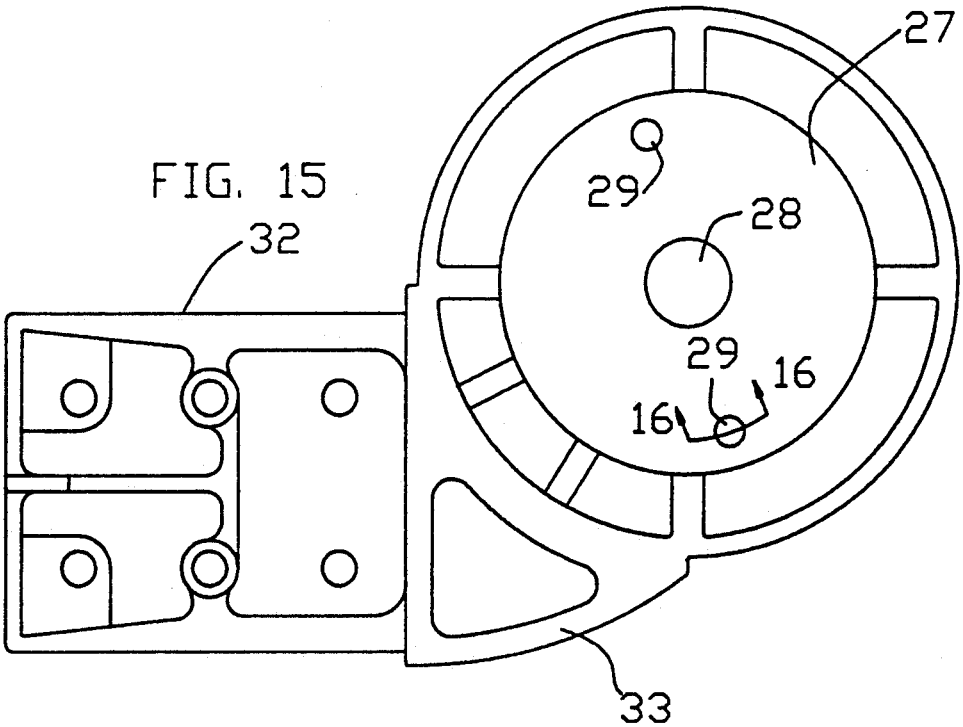
FIG. 15 is an enlarged plan view of the outer or non-tooth side of a male hinge element such as disclosed in FIG. 12, disclosing the unique disk spring mount associated with this outer side.

Referring to FIG. 17 and 18, lever locking structure 21 is disclosed which cooperates with the flattened apertured portion of joint-axle 11 to work against coil spring 19 to hold and lock alignable male and female teeth sets 13 and 1 in intermeshed relation when they are aligned and engaged in a preselected angular position as above discussed. The lever locking structure 21 includes a manually operable gripping arm 22 having a bifurcated end 23 to pivotally engage With the flattened apertured portion of joint axle 11 with an appropriate aperture 24 serving to receive a pivot pin (not shown) passed therethrough to engage with aligned aperture 10 in the flattened portion of joint axle 11. It is to be noted that locking structure 21 includes an over-center camming surface 26. Referring to FIGS. 15 and 16 of the drawings, camming surface 26 is sized and configured to cooperate with the outer side of one of the two facing hinge plates 7 through a flat disk spring 27 having an aperture 28 therein sized to be mounted on joint axle 11 which passes therethrough. Disk spring 27, which can be in the form of a thin metal disk sufficiently flexible to permit "oil canning" when engaged by over-center camming surface 26 has two diametrically opposed smaller apertures 29, each of which engages in a circumferential recess 31 in one of two spaced posts 32' extending normally from the outer face of hinge plate 7 to maintain the disk spring 27 in spaced relation from the outer face of hinge plate 7 and in "oil camming" relation with over-center camming surface 26 of pivotally mounted lever locking structure 21. Thus, flexible disk spring 27 allows over center cam surface movement while continuously applying pressure.

Figure 4:
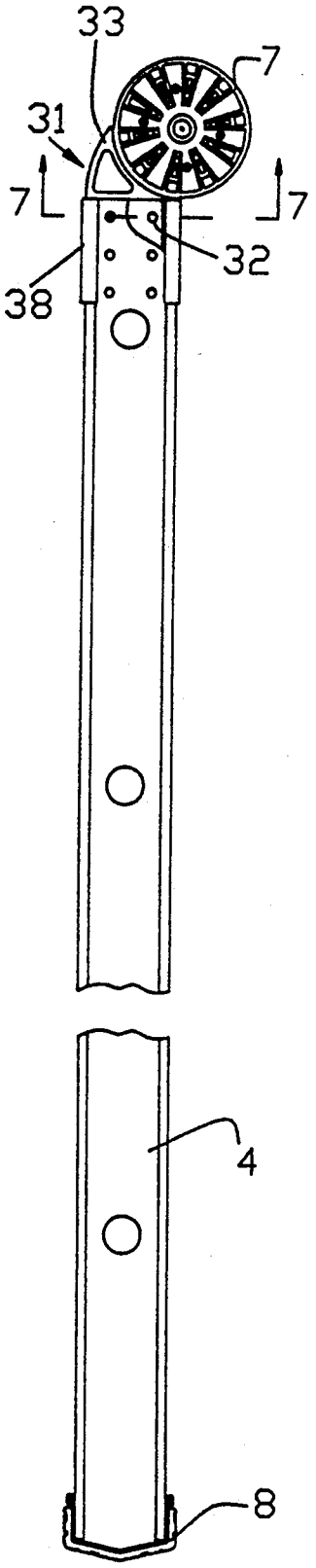
FIG. 4 is a partially broken, side view of an end rail of an end ladder assembly of FIGS. 1-3, this side view disclosing the teeth face of a male hinge element of plate associated with the ladder rail disclosed in this FIGURE.
Figure 5:
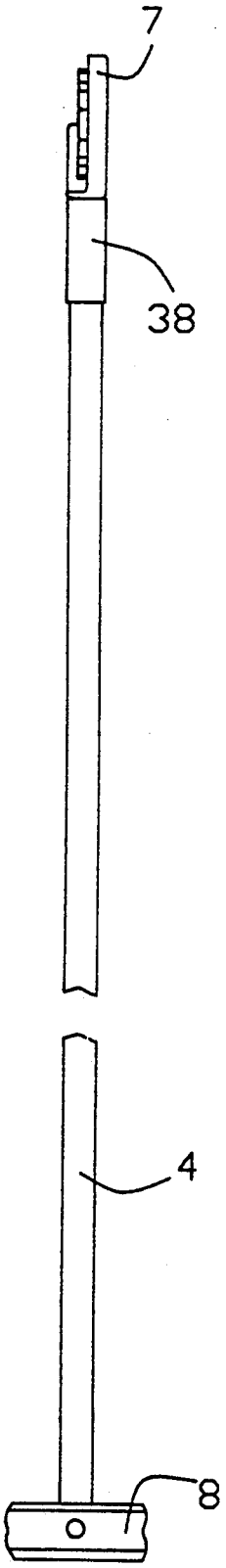
FIG. 5 is a partially broken, edge view of the end rail of FIG. 4.
Figure 6:
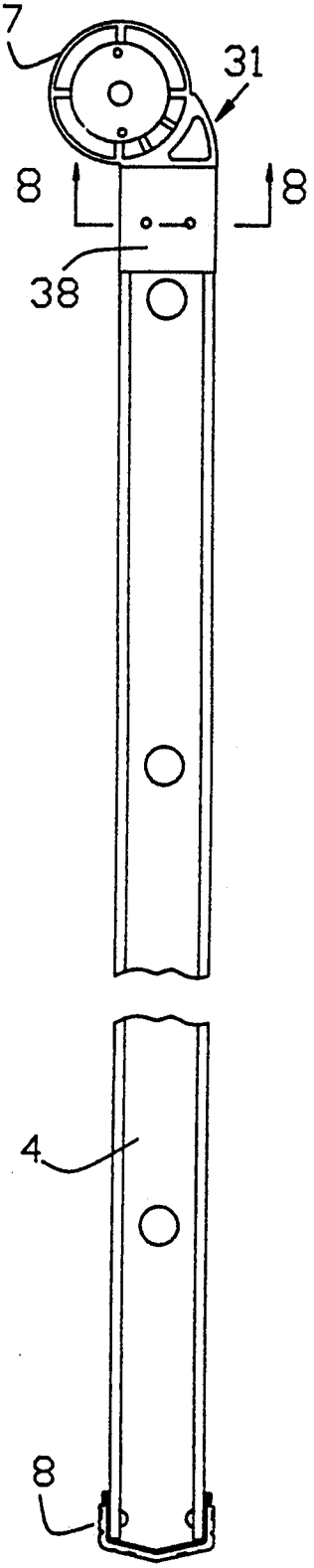
FIG. 6 is an opposite partially broken, side view of the end rail of FIG. 4.
Figure 7:
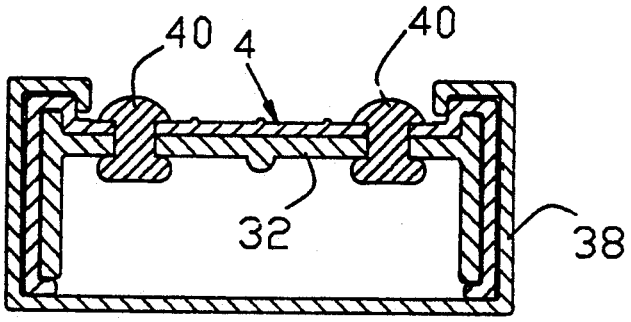
FIG. 7 is a cross-sectional view taken in a plane through line 7—7 of FIG. 4, disclosing the rectangular portion of the stem assembly of the hinge element connected by rivets to the rail with the reinforcing wraparound section extending therearound.
Figure 8:
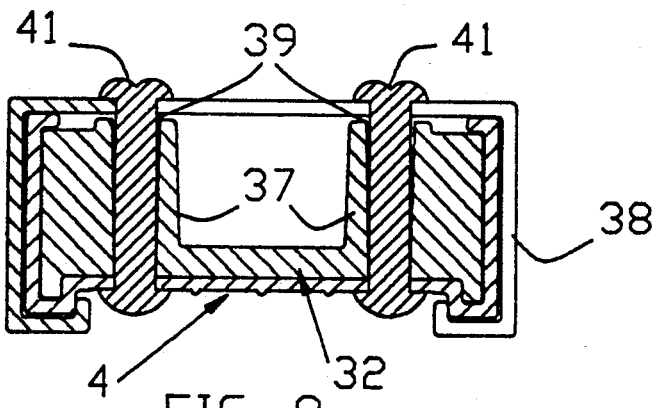
FIG. 8 is a cross-sectional view taken in a plane through line 8—8 of F 6, disclosing the rectangular portion of the stem assembly connected to the wraparound section by rivets extending through rivet guides in the stem assembly.

Referring to FIGS. 4–8 and 10–15 as well as the overall views of FIGS. 1–3, it can be seen that each hinge plate 7, which plate can be made from a suitable cast aluminum material or other suitable material, includes a stem assembly 31 which is arranged to extend at a preselected angle from a quadrant of the hinge plate 7. As can be seen in FIGS. 12 and 13, the stem assembly 31 includes a rectangular bayonet portion 32 and a triangular transitional portion 33 extending between hinge plate 7 and rectangular portion 32. It is to be noted that the hypotenuse of triangular transitional position 32 is appropriately curved at 34 to nestingly conform in fixed relation with a preselected peripheral quadrant of circular hinge plate 7. It is to be noted that stem assembly 31 is so positioned relative circular hinge plate 7 as to not obscure angular position indexing marks 30 which are appropriately placed on the periphery of one of the mating hinge plates to indicate the appropriate angular locking position of one plate of a male-female pair with respect to the other by a marking arrow on such other hinge plate (FIG. 14). As can be seen in FIG. 7, suitable headed rivets 40, guided through spaced apertures in rectangular stem portion 32 and rail 4, can be appropriately bucked to fasten rail 4 and rectangular stem portion 32 firmly together in fast relation. As can be seen in FIGS. 4 and 7 of the drawings, the rectangular portion 32 of stem assembly 31 and the adjacent end of each ladder rail 4 are sized to telescopically engage in respective male-female relation. As can be seen in FIGS. 13 and 15, rectangular portion 32 include integral reinforcing ribs 36 extending thereacross and spaced through guides 37 (FIGS. 8) extending normal from the face thereof along with a reinforcing wrap-around bracket 38 (FIGS. 7 and 8). Wrap-around bracket 38 is slidably mounted on ladder rail 4 with spaced apertures 39 positioned to align with spaced through guides 37 on rectangular portion 32 of stem assembly 31. As can be seen in FIG. 8, suitable headed rivets 4 can be appropriately bucked to fasten bracket 38, rail 4 and rectangular bayonet portion 32 firmly together in fast relation. It is to be understood that advantageously hinge elements 7 with the stem assembly 31 including ribbed and through guide rectangular portion 32 and triangular transition portion 33 can all be formed in one aluminum casting operation or can be formed as several parts appropriately welded or fused together.

Figure 9:
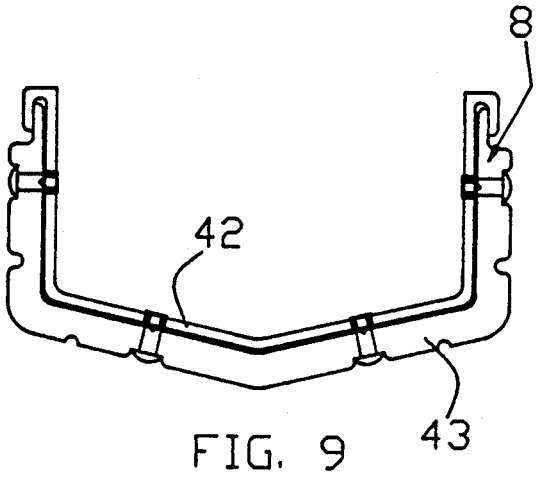
FIG. 9 an enlarged, cross-sectional view of the stabilizing bar at the bottom end of the rail of FIGS. 4–6.
Figure 11:
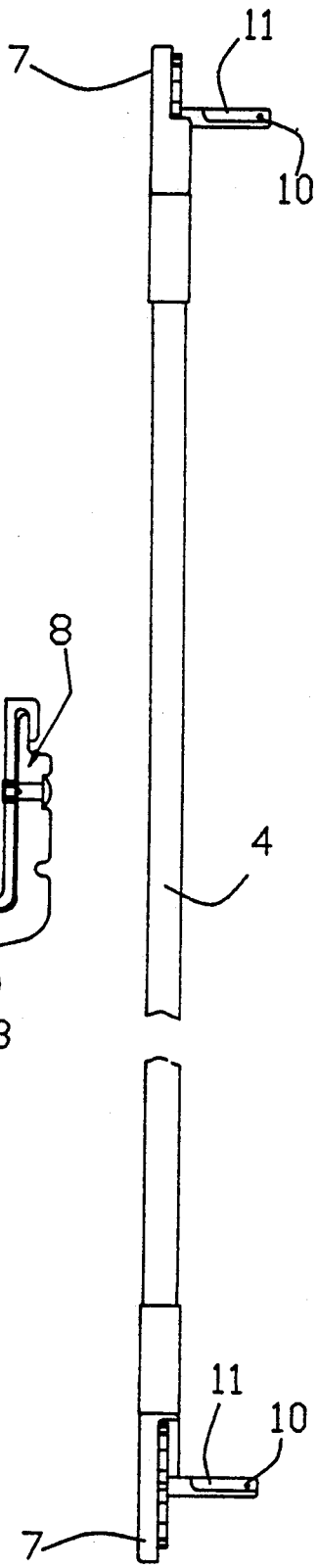
FIG. 11 is a partially broken, edge view of the intermediate rail of FIG. 10, similar to the edge view of FIG. 5, this FIG. 11 further disclosing the joint axles projecting through the hinge plates thereof.
Figure 10:
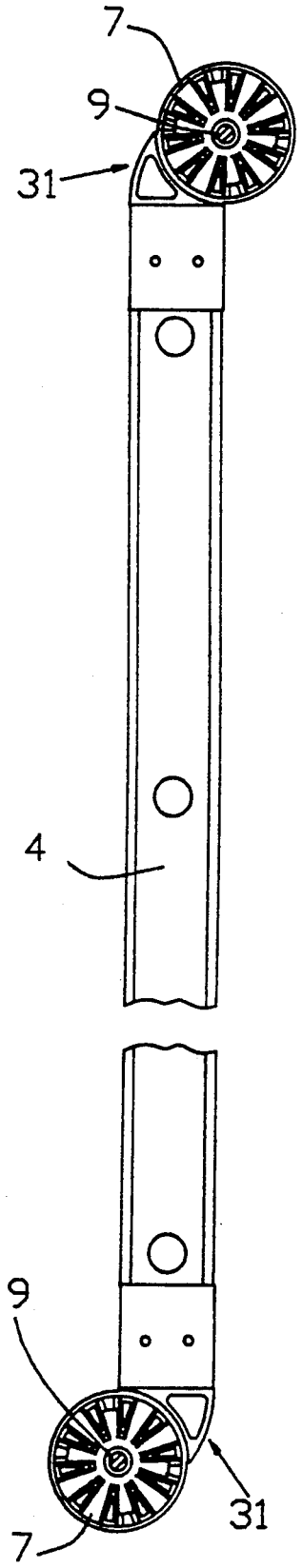
FIG. 10 is a partially broken, side view of an intermediate rail of an intermediate ladder rail section of the ladder assembly of FIGS. 1–3, this side view disclosing the teeth faces of a female hinge element or plate associated with the intermediate ladder rail disclosed in this FIGURE and matingly engageable with the teeth face of a male hinge element such as disclosed in FIGS. 4–6.

Again, referring to FIGS. 1-3 and also to FIG. 9, details of the unique stabilizing bar 8 mounted at the foot of each of the end ladder sections can be seen. Stabilizing bar 8 includes a longitudinal extending U-shaped bar member 42, which also can be formed of strong aluminum material, sized to have the base thereof snuggly engage the bottom of rail 4 with the sides snuggle engaging and fastened to the side faces of opposed rails 4 of the end rail sections 3. As can be seen in the drawings, particularly FIG. 9, the opposite ends of each stabilizing bar 8 is provided with a pair of ribbed tread members 43 which can be appropriately riveted to bar 42 to extend beyond the base of ladder rail section 3 to enhance and stabilize the support of articulated adjustable position ladder assembly 2. To further enhance and to further stabilize ladder assembly 2 and, in accordance with the present invention, each stabilizing bar 8 including U-shaped bar 42 along with treads 43 fastened thereto are each configured to provide an anngular base to include a pair of relatively angularly disposed, longitudinally extending adjacent alternative base faces, relatively disposed at appropriate angles so as to present alternative fully flush conforming and extended flat faces to an opposed support surface for each end ladder section 3, all in accordance with a preselected step ladder, straight ladder, and platform angular position of the ladder sections 3 of adjustable ladder assembly 2 or any other position contemplated.

Thus, from the above it can be seen that a multi-featured articulated ladder structure is provided which can be readily manufactured, assembled and articulated in a straightforward, efficient and economical manner.

The invention claimed is:

1. An adjustable position ladder joint assembly for connecting and selectively positioning adjacent ends of at least one pair of adjacent ladder rails of adjacent ladder rail sections positionable in more than one relative fixed angular position comprising:

first and second oppositely facing hinge elements connected to adjacent ends of each of said adjacent pair of ladder rails, said oppositely facing hinge elements being mounted on a joint axle to be rotably and longitudinally movable with respect to each other on said joint axle with opposed faces of said hinge elements having sets of offset alignable, interlockable, and intermeshable, rotationally arrestable when fully engaged teeth extending radially between said rims and joint axle to allow said teeth on said opposed oppositely facing hinge elements to be positionally rotated and radially aligned when said facing hinge elements are spaced apart to be urged and held in interlockably and intermeshably fully engaged relation with said teeth being rotationally arrested and locked at preselected angular hinge positions with respect to each other, said sets of teeth including preselectively positioned block means in one set and cooperative aperture means in the other set to be cooperative therebetween to allow intermeshing engagement at said sets of teeth only at said preselected angular hinge positions with said block means and cooperative aperture means further providing intermeshing shear resisting strength;

means to urge said facing hinge elements apart on said axle for such positional rotation on said axle; and, lever holding and locking means pivotally cooperable with said joint axle to longitudinally urge, hold and lock said hinge elements together with their respective teeth intermeshed and rotationally arrested thus longitudinally holding and locking said opposed hinge elements at a preselected angularly hinged rotationally arrested position.

2. The ladder joint assembly for adjacent ladder rail sections of claim 1, said preselected angular hinged positions allowing said adjacent hinged ladder rails to be hinged in locked position relative to each other including a first longitudinally parallel facing collapsed position for said hinged ladder rails and at least one different preselected second angular position for said hinged rails.

3. The ladder joint assembly for adjacent ladder rail sections of claim 1, said preselected angular positions allowing said adjacent hinged ladder rails to be in locked position relative each other including a first longitudinally parallel facing collapsed position, a second step-ladder rail position, a third platform ladder rail position and a fourth straight ladder rail position.

4. The ladder joint assembly for adjacent ladder rail sections of claim 1, said preselected angular positions allowing said adjacent hinged ladder rails to be fixedly positioned relative each other to define angle positions of approximately 0°, 36°, 108° and 180°.

5. The ladder joint assembly for adjacent ladder rail sections of claim 1, said opposed oppositely facing hinge elements being circular with said sets of offset, alignable, intermeshable and rotationally arrestable teeth extending radially from a position adjacent said periphery of said circular hinge elements preselectively proximate said joint axle to optimize shear resisting strength of said teeth when in intermeshed and rotationally arrested engaged position.

6. The ladder joint assembly for adjacent ladder rail sections of claim 1, said oppositely facing hinge elements being of corresponding circular shape with each set of offset alignable, intermeshable and rotationally arrestable teeth including spaced radially extending teeth sufficient in number to allow said adjacent ladder rails to be in hinged positioned relative each other to define at least two possible locked preselected angular positions with one set of spaced teeth serving as the male set to include a pair of prime teeth extending radially 180° apart and with the other set of teeth serving as the female set having prime tooth blocks between preselected spaced teeth to allow said prime teeth of said male set to intermeshably and rotationally arrestably engage only with said female set of teeth at said preselected angular positions.

7. The ladder joint assembly for adjacent ladder rail sections of claim 1, said opposed oppositely facing hinge elements each being of corresponding circular shape with a longitudinally and inwardly extending peripheral rim to surround said sets of offset intermeshable, rotationally arrestable teeth and to adjacently face each other when said sets of teeth are aligned and intermeshed, each set of offset alignable and intermeshable, rotationally arrestable teeth including a plurality of triangularly shaped teeth defining a triangularly shaped aperture therein with said teeth extending radially from said peripheral rim with the apices preselectively positioned proximate said joint axle to optimize shear resisting strength of said teeth when in intermeshed engaged position, one set of spaced teeth serving as the male set to include a pair of prime triangular teeth extending radially toward each other from said peripheral rim at positions 180° apart with the other triangularly shaped teeth of said male set having the base truncated portions stepped down to be substantially even with the top face of its peripheral rime, the other set of teeth serving as the female set having prime tooth blocks each in the form of a raised truncated triangle sized and positioned adjacent its peripheral rim to engage a truncated triangular aperture in one of said base truncated portions of said opposite male teeth, said prime tooth blocks being positioned between preselected spaced female teeth to allow said prime teeth of said male set to intermeshingly engage only with said female set of teeth at preselected angular positions with said truncated prime tooth blocks on said female set of teeth intermeshing with said base truncated apertures of said male set of teeth to further increase intermeshing shear resisting strength.

8. The ladder joint assembly for adjacent ladder rail sections of claim 1, said means to urge said hinge elements apart on said axle for positional rotation on said axle comprising a coil spring surrounding said axle and interposed between said first and second oppositely facing hinge elements.

9. The ladder joint assembly for adjacent ladder rail sections of claim 1, said lever locking means pivotally cooperable with said joint axle including a gripping lever pivotally mounted on said joint axle, said gripping lever having an off-center camming surface to cooperate with the outer side of one of said first and second oppositely facing hinge elements.

10. The ladder joint assembly for adjacent ladder rail sections of claim 1, said lever locking means pivotally cooperable with said joint axle including an aperture flat disk spring mounted around said axle and held in spaced facing relation to the outer non-teeth set side of one of said first and second oppositely facing disks; and, a gripping lever pivotally mounted on said joint axle at an extremely thereof opposite said surrounding flat disk spring, said gripping lever having an offset camming surface abutting said flat disk spring to urgingly "oil-can" said spring and lock said oppositely facing hinge elements in a preselected angular position.

11. The ladder joint assembly for adjacent ladder rail sections of claim 1, said first and second oppositely facing hinge elements each including a stem assembly extending at a preselected distance and angle from said hinge elements, said stem assembly being adapted to receive a corresponding end of one of said adjacent ladder rails.

12. The ladder joint assembly for adjacent ladder rail sections of claim 1, said first and second oppositely facing hinge elements each including a stem assembly extending at a preselected distance and angle from said hinge element, said stem assembly including a rectangular portion and a transitional portion between said hinge element and said rectangular portion, said rectangular portion and said adjacent end of said ladder rail being sized to telescopically engage to be releasably held together in fast reinforced relationship.

13. The ladder joint assembly of claim 1, said opposed oppositely facing hinge elements being circular with said sets of offset intermeshed teeth extended radially from a position adjacent said periphery of said circular hinge elements preselectively proximate said joint axle, each hinge element including a stem assembly extending at a preselected distance and angle from said hinge element, said stem assembly including a rectangular portion and a triangular-like transitional portion between said hinge element and said rectangular portion with the hypotenuse of said transitional portion being curved to nest in fixed relation with a preselected peripheral portion of said circular hinge element without obscuring angular position indexing marks on the periphery of said circular hinge element.

14. The ladder joint assembly of claim 1, said first and second oppositely facing hinge elements each including a stem assembly extending at a preselected distance and angle from said hinge element, said stem assembly being sized and adapted to telescopically receive a corresponding end of one said adjacent ladder rails; and, a wrap around bracket reinforcing said telescoping stem assembly and ladder rail end including at least one fastener to hold said telescoping stem assembly and ladder rail in releasably fast relation.

15. The ladder joint assembly of claim 1, said opposed hinge elements being circular with said sets of offset intermeshed teeth extending radially from a position adjacent said periphery of said circular elements preselectively proximate said joint axle, each hinge element including a stem assembly extending at a preselected distance and angle from said hinge element, said stem assembly including a rectangular portion and a triangular-like transitional position between said hinge element and said rectangular portion with the hypotenuse of said transitional portion being curved to nestingly conform in fixed relation with a preselected peripheral quadrant portion of said circular hinge element without obscuring angular position indexing marks on the periphery of said circular hinge element, said rectangular portion of said stem assembly and said adjacent end of said ladder rail being sized to telescopically engage in respective male-female relation with said rectangular portion having reinforcing ribs extending thereacross and spaced through fastened guides extending normal from the face thereof and a reinforcing wrap-around bracket telescopically and slidably mounted on said ladder with spaced apertures therein positioned to align with said spaced through fasteners to accommodate said fasteners to hold the several parts together in fast reinforced relation.

16. The ladder joint assembly of claim 1, said pair of adjacent ladder rails cooperatively assembled with a like pair of ladder rails extending substantially parallel thereto and joined therewith by a set of normally extending spaced rungs to form a pair of adjacent ladder sections with oppositely facing hinge elements at only one end extremity of said ladder sections and the opposite end extremities having U-shaped stabilizing means vesting therewith with said hinge elements allowing said adjacent hinged ladder sections to be hinged in locked position relative each other in several different angular positions including a first longitudinally parallel facing collapsed position, a straight-line position and at least two intermediate angular positions, said stabilizing means including bottom faces configured to present conforming alternative faces to an opposed support surface for said ladder sections when said ladder sections are hinged in locked position in one of said intermediate angular positions.

17. The ladder joint assembly of claim 16, said stabilizing means comprising at least one stabilizing bar sized to extend beyond said spaced ladder rail sections forming at least one of said ladder sections and to be joined thereto, said stabilizing bar having a tread configured to present said alternative conforming faces to said opposed support face in accordance with said selected intermediate angular position.

18. A stabilizing bar to be mounted at the foot of a ladder section including at least two spaced substantially parallel rails having spaced rungs extending normally therebetween comprising a longitudinally extending bar member with a substantially U-shaped cross section with an angular base, said longitudinally extending bar member being sized to extend between and snugly nestingly engage with and be fastened to the end spaced extremities of said spaced rials and to extend a preselected longitudinal distance there beyond, with said angular base including a pair of angularly disposed, longitudinally extending adjacent alternative base faces, said stabilizing bar having a pair of longitudinally extending tread members fastened to said angularly disposed alternative base faces thereof, said alternative base faces and said tread members being configured to present flush flat alternatively conforming faces to an opposed support surface for said ladder section in accordance with preselected angular positions of said ladder.

19. An adjustable position ladder assembly including at least four ladder rail sections including two intermediate and two end sections hingedly connected with the two intermediate sections hingedly connected to each other and to the two end sections so as to be positioned in locked relation in at least four angular positions including a first longitudinally parallel facing collapsed position, a second step-ladder position, a third ladder platform position and a fourth straight ladder position, each of said four ladder sections including two spaced substantially parallel rails having spaced rungs extending normally therebetween, said ladder sections including joint assemblies for connecting and selectively positioning adjacent ends of said ladder rails of said ladder sections in one of said four positions, each assembly including a pair of first and second oppositely facing hinge plates connected to adjacent ends of each of said adjacent ladder rails, said oppositely facing hinge plates being mounted on a joint axle to be rotably and longitudinally movable with respect to each other on said joint axle with opposed faces of said hinge plates having sets of offset alignable, intermeshable rotationally arrestable when fully engaged teeth radially extending between said rims and joint axle to allow said teeth on said opposed hinge oppositely facing plates to be positionally rotable and radially aligned when said facing hinge elements are spaced apart to be urged and held in intermeshably engaged relation with said teeth being rotationally arrested and locked at a preselected angularly hinge positions with respect to each other, said sets of teeth including preselectively positioned block means in one set and cooperative aperture means in the other set cooperative therebetween to allow intermeshing engagement of said sets of teeth only at said preselected angular hinge positions with said block means and cooperative aperture means providing further intermeshing shear resisting strength;

means to urge said facing hinge elements apart on said axle for such positional rotation on said axle; and lever holding and locking means pivotally cooperable with said joint axle to longitudinally urge, hold and lock said aligned hinge plates together with their respective teeth intermeshed and rotationally arrested thus longitudinally holding and locking said opposed hinge plates at a preselected angular hinged position.

20. An adjustable position ladder assembly including at least four ladder rail sections including two intermediate and two end sections hingedly connected with the two intermediate sections hingedly connected to each other and to the two end sections so as to be positioned in locked relation in at least four angular positions including a first longitudinally parallel approximately zero degree (0°) collapsed position, a second approximately thirty-six (36°) step-ladder position, a third approximately one hundred eight degree (108°) ladder platform position and a fourth approximately one hundred and eight degree (180°) straight ladder position, each of said four ladder sections including two spaced substantially parallel rails having spaced rungs extending normally therebetween, said ladder sections including joint assemblies for connecting and selectively positioning adjacent end of said ladder rails of said ladder sections in one of said four positions, each assembly including a pair of first and second oppositely facing hinge plates connected to adjacent ends of each of said adjacent pair of ladder rails, said opposed hinge plates being mounted on a joint axle to be rotably and longitudinally moveable with respect to each other on said joint axle, each being of corresponding circular shape with a longitudinally and inwardly extending peripheral rim to surround sets of offset alignable, interlockable, rotationally arrestable when fully engaged intermeshably radially extending teeth and to adjacently face each other when said sets of teeth are intermeshed, each set of offset intermeshable teeth including a plurality of triangularly shaped teeth defining a triangularly shaped aperture therein with said teeth extending radially from said peripheral rim with the apices preselectively positioned proximate said joint axle to optimize shear resistance strength of said teeth when in intermeshed and interlocked engaged position, one set of spaced teeth serving as the male set to include a pair of prime triangular teeth extending radially toward each other from said peripheral rim at positions 180° apart with the other triangularly shaped teeth of said male set having the base truncated portions stepped down to be substantially even with the top face of its peripheral rim, the other set of teeth serving as the female set having prime tooth blocks, each including a raised truncated triangle sized and positioned adjacent its peripheral rim to engage a truncated triangular aperture in one of said base truncated portions of said opposite male teeth, said prime tooth blocks being positioned between preselected spaced female teeth to allow said prime teeth of said male set to intermeshingly engage only with said female set of teeth at preselected angular positions, with said raised truncated triangles on said female set of teeth intermeshing with said base truncated apertures of said male set of teeth to further increase intermeshing and interlocking shear resisting strength; means to urge said circular hinge plates apart on said joint axle for positional rotation on said joint axle including a coil spring surrounding said joint axle adjacent said teeth apices and interposed between said pair of first and second oppositely facing hinge plates; lever locking means pivotally cooperable with said joint axle including a gripping lever pivotally mounted on said joint axle, said gripping lever having an over-center camming surface to cooperate with the outer side of one of said first and second oppositely facing hinge plates, said joint axle including an apertured flat disk spring mounted on said joint axle and held in spaced facing relation to the outer non-teeth set side of one of said pair of first and second oppositely facing plate between said camming surface and said outer side, a stem assembly extending at a preselected angle from said hinge plate, said stem assembly including a rectangular portion, and a triangular-like transitional portion between said hinge plate and said rectangular portion with the hypotenuse of said transitional portion being curved to nestingly conform in fixed relation with a preselect peripheral quadrant portion of said circular hinge plate without obsuring angular position indexing marks on the periphery of said circular hinge plate, said rectangular portion of said stem assembly and said adjacent end of said ladder rail being sized to telescopically engage in respective male-female relation with said rectangular portion having reinforcing ribs extending thereaccross and spaced through guides extending normal from the face thereof and a reinforcing wrap-around bracket telescopically and slidably mounted on said ladder rail with spaced apertures therein positioned to align with said spaced through guides on said rectangular portion of said stem assembly to accommodate rivet assemblies to hold the several parts together in fast reinforced relation; and, a stabilizing bar ends and said trend members being configured at an appropriate angle to present alternatively fully flat and flushed conforming extending faces to an opposed support surface for said ladder section in accordance with a preselected step ladder and platform angular position of said ladder assembly.

* * * * *

UNITED STATES PATENT AND TRADEMARK OFFICE

CERTIFICATE OF CORRECTION

PATENT NO. : 5,279,387

DATED : January 18, 1994

INVENTOR(S) : Paul R. Swiderski, et al

It is certified that error appears in the above-indentified patent and that said Letters Patent is hereby corrected as shown below:

Column 2, Line 67, delete "F 6" and insert --Fig. 6--
Column 3, Line 4, after "bar" insert -- disclosed --
Column 4, Lines 16 & 17, delete "mating oppositely facing" and insert-- oppositely facing mating --
Column 5, Line 14, delete "lock" and insert -- and locked --
Column 5, Line 15, delete "arrest" and insert -- arrested --
Column 5, Line 16, delete "teeth 1" and insert -- teeth 13 --
Column 5, Line 19, after "180" insert --° --
Column 5, Line 44, delete "note" and insert -- noted --
Column 6, Line 2, delete "1" and insert -- 14 --
Column 6, Line 6, delete "With" and insert -- with --
Column 7, Line 26, delete "anngular" and insert -- angular --
Column 9, Line 9, delete "rime" and insert -- rim --
Column 9, Line 23, after "said", second occurrence, insert -- oppositely facing --
Column 9, Line 64, after "assembly" insert -- for adjacent ladder rail sections --

UNITED STATES PATENT AND TRADEMARK OFFICE

CERTIFICATE OF CORRECTION

PATENT NO. : 5,279,387

DATED : January 18, 1994

INVENTOR(S) : Paul R. Swiderski, et al

It is certified that error appears in the above-indentified patent and that said Letters Patent is hereby corrected as shown below:

Column 10, Line 11, after "assembly" insert -- for adjacent ladder rail sections --
Column 10, Line 21, after "assembly" insert -- for adjacent ladder rail sections --
Column 10, Line 21, after "opposed" insert -- oppositely facing --
Column 10, Line 47, after "assembly" insert - for adjacent ladder rail sections --
Column 10, Line 55, delete "vesting" and insert -- Nesting--.
Column 12, Line 15, delete "eight" and insert -- eighty --
Column 12, Line 20, delete "end" and insert -- ends --
Column 14, Line 10, after "bar" insert -- mounted at the foot of each of said end ladder sections, said stabilizing bar including a longitudinally extending U-shaped bar member sized to snugly engage and be fastened to the bottoms of said spaced rails of each ladder section to extend a preselected longitudinal distance there beyond, said stabilizing bar having a pair of tread members fastened to the base ends thereof, said stabilizing bar --
Column 14, Line 10, delete "trend" and insert -- tread --
Column 10, line 66, after "assembly" insert --for adjacent ladder rail sections--.

Signed and Sealed this

Twenty-first Day of February, 1995

*Attest:*

Bruce Lehman

BRUCE LEHMAN

*Attesting Officer*

*Commissioner of Patents and Trademarks*